US010908529B2

(12) United States Patent
Berger et al.

(10) Patent No.: US 10,908,529 B2
(45) Date of Patent: Feb. 2, 2021

(54) PRINT AGENT SUPPLY UNIT VALVE

(71) Applicant: HP Indigo B.V., Amstelveen (NL)

(72) Inventors: Shachar Berger, Ness Ziona (IL); Sagie Shanun, Ness Ziona (IL); Ziv Yosef, Ness Ziona (IL); Sarah Ann Russell, San Diego, CA (US); Eric G Nelson, Boise, ID (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/606,759

(22) PCT Filed: Sep. 21, 2017

(86) PCT No.: PCT/US2017/052647
§ 371 (c)(1),
(2) Date: Oct. 20, 2019

(87) PCT Pub. No.: WO2019/059910
PCT Pub. Date: Mar. 28, 2019

(65) Prior Publication Data

US 2020/0209783 A1 Jul. 2, 2020

(51) Int. Cl.
*G03G 15/08* (2006.01)
*B41J 2/175* (2006.01)

(52) U.S. Cl.
CPC ..... *G03G 15/0865* (2013.01); *B41J 2/17596* (2013.01); *G03G 15/0886* (2013.01)

(58) Field of Classification Search
CPC ..... G03G 15/0865; G03G 15/0867; G03G 15/0881; G03G 15/0886; G03G 15/10; G03G 2215/066; G03G 2215/0668; B41J 2/17513; B41J 2/17596
See application file for complete search history.

(56) References Cited

U.S. PATENT DOCUMENTS 4,489,858 A * 12/1984 Pritchitt ..... G03G 15/104 222/182
6,125,254 A * 9/2000 Chang ..... G03G 15/10 141/348
6,137,972 A * 10/2000 Playfair ..... G03G 15/0865 141/363
7,311,389 B1 12/2007 Pidgeon
7,458,664 B2 12/2008 Sato et al.
8,261,927 B1 9/2012 Volzke et al.
(Continued)

FOREIGN PATENT DOCUMENTS

CN 1860032 11/2006
CN 201304756 9/2009
(Continued)

OTHER PUBLICATIONS

Chen, P et al., Hydrodynamic Gating Valve for Microfluidic Fluorescence-activated Cell Sorting, Mar. 17, 2010.

*Primary Examiner* — Sophia S Chen
(74) *Attorney, Agent, or Firm* — Fabian VanCott

(57) ABSTRACT

A print agent supply unit includes: an inlet chamber to distribute print agent within the print agent supply unit; a valve to selectively permit print agent into the inlet chamber, the valve including: a print agent inlet opening; and a valve member to selectively close the print agent inlet opening, the valve member being tapered towards an upstream end of the valve member.

19 Claims, 4 Drawing Sheets

(56) References Cited

U.S. PATENT DOCUMENTS

| | | | | |
|---|---|---|---|---|
| 8,774,682 | B2 | 7/2014 | Bhattacharyya et al. | |
| 9,244,390 | B2 | 1/2016 | Lam et al. | |
| 9,291,948 | B2 | 3/2016 | Tanner et al. | |
| 2004/0079424 | A1 | 4/2004 | Takeda et al. | |
| 2009/0219353 | A1* | 9/2009 | Price | B41J 2/17596 347/86 |
| 2014/0369719 | A1* | 12/2014 | Leemhuis | G03G 15/0865 399/262 |
| 2016/0033898 | A1* | 2/2016 | Yamabe | G03G 15/0886 399/258 |

FOREIGN PATENT DOCUMENTS

| | | |
|---|---|---|
| CN | 101553664 | 10/2009 |
| CN | 101978199 | 2/2011 |
| CN | 102803804 | 11/2012 |
| CN | 205386990 | 7/2016 |
| EP | 0425144 A2 | 5/1991 |

* cited by examiner

PRINT AGENT SUPPLY UNIT VALVE

BACKGROUND

In printing, print agents such as inks or toners (generally, 'print agents') may be applied to a substrates. Substrates may in principle comprise any material, for example comprising paper, card, plastics, fabrics, or the like.

In some examples of printing techniques, charged print agents, such as charged toner particles or resins, may be applied to a charged photoconductive surface. In some examples, such print agents are subsequently transferred to a substrate.

BRIEF DESCRIPTION OF DRAWINGS

Non-limiting examples will now be described with reference to the accompanying drawings, in which.

DETAILED DESCRIPTION

In some examples, a print apparatus may comprise an electrophotographic print apparatus such as a Liquid Electro Photographic (LEP) print apparatus which may be used to print a print agent such as an electrostatic printing fluid or composition (which may be more generally referred to as "an electronic ink" in some examples). Such a printing fluid may comprise electrostatically charged or chargeable particles (for example, resin or toner particles which may be colored particles) dispersed in a carrier fluid. A photo charging unit may deposit a substantially uniform static charge on a photoconductive surface (which may be termed a photo imaging plate, or 'PIP'). In some examples, such a charge is transferred to the photoconductive surface via a charge transfer roller which is in contract with the photoconductive surface, although non-contact methods of charge transfer may be used. A write head, which may for example comprise at least one laser, may be used to dissipate the static charge in selected portions of the image area on the photoconductive surface to leave a latent electrostatic image.

The electrostatic printing fluid composition (generally referred to herein as a 'print agent') is transferred to the photoconductive surface from a print agent source using a print agent supply unit (which may be termed a Binary Ink Developer (BID) unit in some examples), which may present a substantially uniform film of the print agent to the photoconductive surface for example via a print agent application roller.

Figure 1:
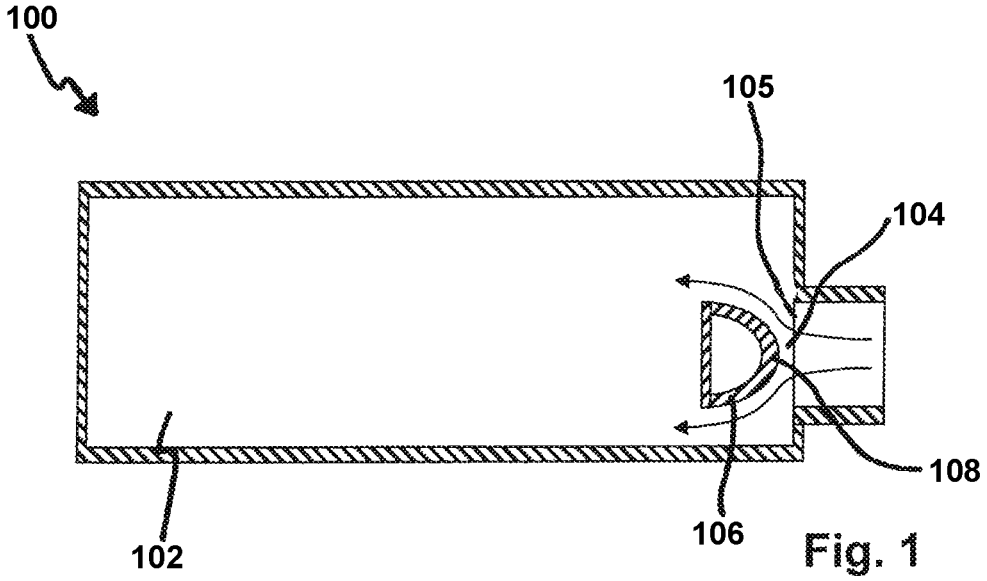
FIG. 1 is a schematic representation of an example print agent supply unit.

FIG. 1 is an example of a print agent supply unit 100.

The print agent supply unit 100 comprises an inlet chamber 102 to distribute print agent within the print agent supply unit 100. Print agent supply unit 100 also comprises a valve 104 to selectively permit print agent to flow into the inlet chamber 102. The valve 104 comprises a print agent inlet opening 105 and a valve member 106 to selectively close the print agent inlet opening 104. The valve member 106 is tapered towards an upstream end 108 of the valve member.

The tapering of the valve member 106 towards the upstream end 108 may improve streamlined flow of print agent past the valve member 106, as illustrated by the arrows in FIG. 1. Therefore, the print agent may reduce flow disturbance of print agent flow into the print agent supply unit 100, thereby improving print agent flow and pressure distribution within the print agent supply unit 100 and along the length of the chamber 102. The valve member 106 may also reduce print agent stagnation around the valve 104 and within the print agent supply unit 100, thereby reducing build-up of print agent sludge around the valve 104 and within the print agent supply unit 100. Furthermore, the reduced cross-sectional area of the valve member 106 at the upstream end 108 may provide increased radial clearance between the valve member 106 and the inlet 105, thereby providing a greater area for print agent flow.

Accordingly, the print agent supply unit 100 and, in particular, the valve member 106, may provide improved print agent flow into the print agent supply unit 100 and improving print agent flow and pressure distribution within the print agent supply unit 100. The examples described may therefore have the overall effect of improving print quality and improving print defects.

In this example, the valve member 106 is tapered curvedly towards the upstream end 108. In this example, the valve member 106" is dome-shaped. In some examples, the valve member 106 may be hemi-spherical. In some examples, the valve member 106 may be parabolically shaped. In other examples, the valve member 106 may be any other shape which tapers towards the upstream end 106. In some examples, the cross sectional area of the valve member 106 may decrease with decreasing distance from the upstream end. In some examples, the cross sectional area of the valve member 106 may increase with increasing distance from the upstream end.

Figure 2:
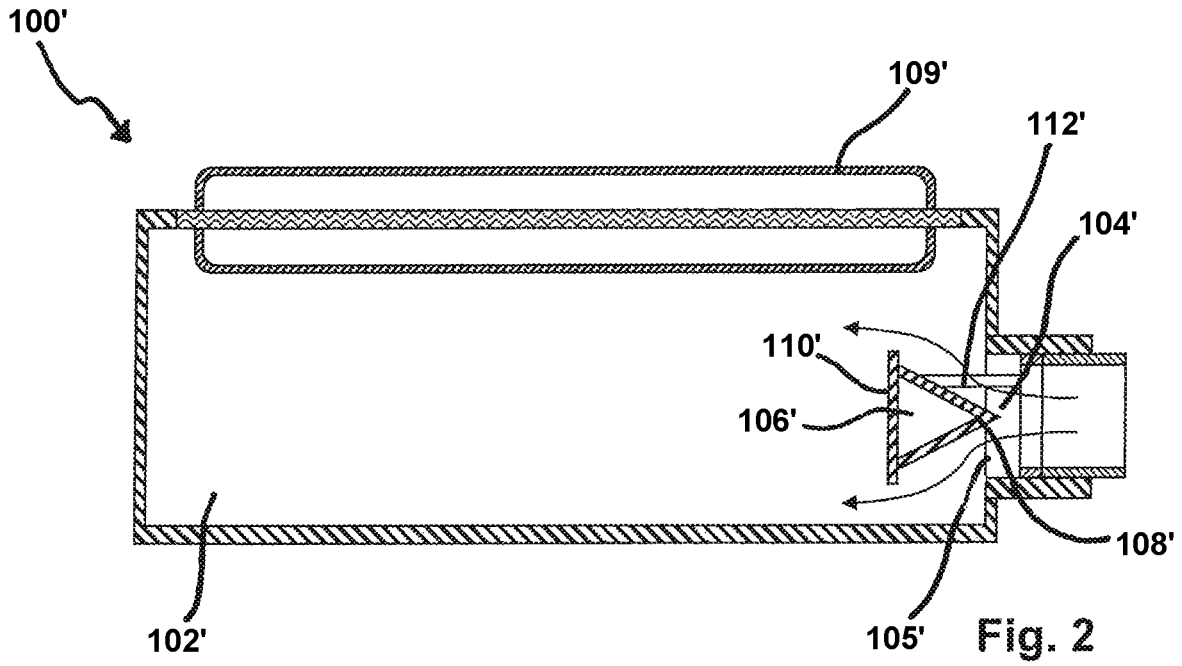
FIG. 2 is a schematic representation of an example print agent supply unit.

FIG. 2 is a further example of a print agent supply unit 100'. The print agent supply unit 100' comprises an inlet chamber 102' to distribute print agent within the print agent supply unit 100'. Print agent supply unit 100' also comprises a valve 104' to selectively permit print agent to flow into the inlet chamber 102'. The valve 104' comprises a print agent inlet opening 105' and a valve member 106' to selectively close the print agent inlet opening 105'. The valve member 106' is tapered towards an upstream end 108' of the valve member.

In this example, the valve member 106' also has a downstream end 110'. The valve member has a larger cross sectional area at a downstream end 110' than at the upstream end 108'.

In some examples, such as this example, the print agent supply unit 100' comprises a print agent application roller 109' to form a substantially uniform film of print agent from the inlet chamber 102'. The valve member 106' may improve flow and pressure distribution along the inlet chamber 102' and thereby along the length of the roller 109'. Accordingly, a more uniform film may be created by the roller 109', which may reduce print defects.

In this example, the valve member 106' is biased to close the print agent inlet opening 105'. Accordingly, the valve member 106' is urged to close the print agent inlet opening 105' in the absence of a sufficient opposing force. In some examples, the valve member 106' may be biased to close the print agent inlet opening with a resiliently deformable member, such as a spring 105'

Figure 2A:
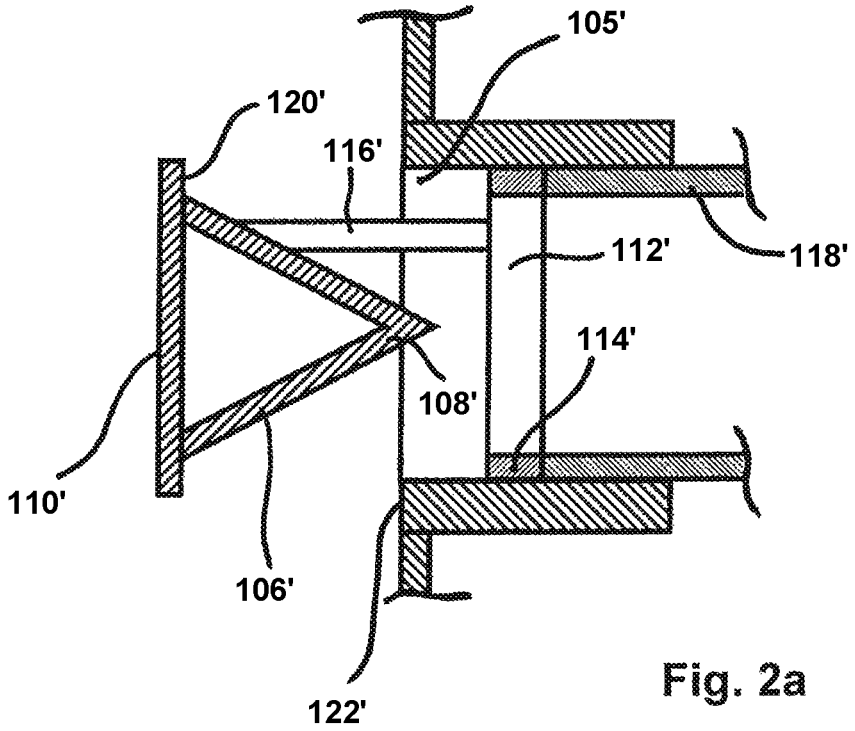
FIG. 2*a* is detailed view of the example print agent supply unit of FIG. 2.

In this example, as shown in more detail in FIG. 2*a*, the print agent supply unit 100' further comprises an opening mechanism 112' to overcome the biasing of the valve member and thereby open the print agent inlet opening 105' when the print agent supply unit 100' is installed in a print apparatus. In this example, the opening mechanism 112' comprises an annular ring 114' arranged upstream of the valve member 106' in the inlet opening 105' and connected to the valve member 106' by a forwardly-extending bar 116'. In this example, when the print agent supply unit 100' is installed in a print apparatus, a corresponding opener mechanism 118' of the print apparatus urges the annular ring 114' inwardly or backwardly along the inlet opening 105', thereby moving the valve member 106' away from the valve opening 105' and opening the valve 104'.

In this example, the valve member 106' is tapered linearly towards the upstream end 108'. In this example, valve member 106' is also conically shaped towards the upstream end 108'.

In this example, the valve member 106' comprises a radially-extending flange 120' at a downstream end 110' of the valve member 106' to abut an annular area 122' about the print agent inlet opening. In this example, the flange 120' forms a sealing contact with the annular area 122' to close the print agent inlet opening 105' when the valve member 106' is in the closed position. In other examples, another part of the valve member 106' may form a sealing contact with the print agent inlet opening 105'

Figure 3:
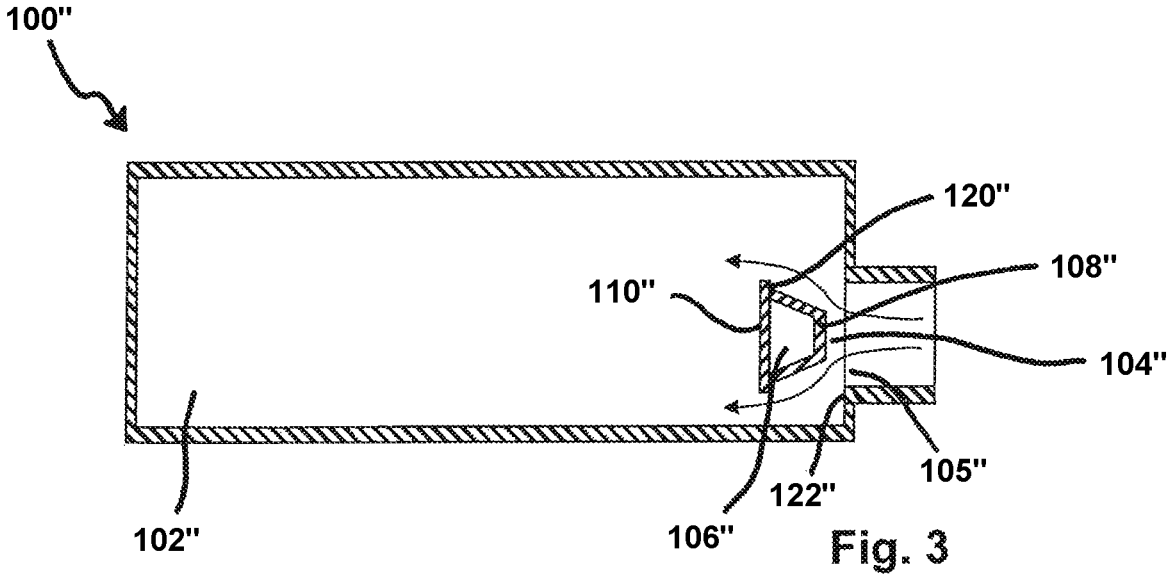
FIG. 3 is a schematic representation of an example print agent supply unit.

FIG. 3 is a further example of a print agent supply unit 100". The print agent supply unit 100" comprises an inlet chamber 102" to distribute print agent within the print agent supply unit 100". Print agent supply unit 100" also comprises a valve 104" to selectively permit print agent to flow into the inlet chamber 102". The valve 104" comprises a print agent inlet opening 105" and a valve member 106" to selectively close the print agent inlet opening 105". The valve member 106" is tapered towards an upstream end 108" of the valve member.

In this example, the valve member 106" comprises a radially-extending flange 120" at a downstream end 110" of the valve member 106" to abut an annular area 122" about the print agent inlet opening.

In this example, the valve member 106" tapers linearly towards the upstream end 108". In this example, the valve member 106" has a frustoconical shape.

In some examples of print agent supply units, the valve member may be additionally tapered towards a downstream end. In such examples, the valve member may have a maximum width or diameter at a middle portion thereof between the upstream end and downstream end of the valve member. The valve member may be tapered linearly or curvedly towards the downstream end. Such a valve member may comprise some or all features of the example stopper of FIG. 10 below.

It should be understood that in some examples, the valve members herein described may be substantially cylindrically symmetric or axisymmetric, such that they have a substantially similar cross sectional shape taken on any plane parallel to a central longitudinal axis of the valve member. In some examples, the valve members may have discrete rotational symmetry about their central longitudinal axis. In some examples, the valve member may be pyramidal in shape. In some examples, a longitudinal axis of the valve member may be generally parallel with a direction of flow of print agent into the print agent supply unit in use.

Figure 4:
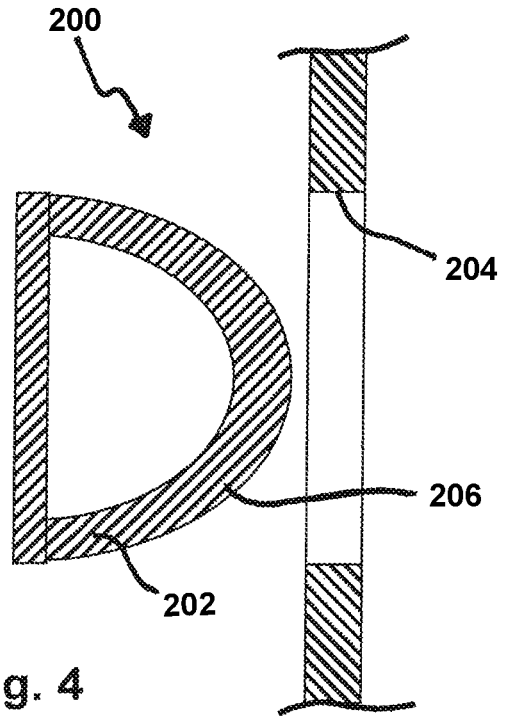
FIG. 4 is a schematic representation of an example print agent supply unit valve.

FIG. 4 is an example of a print agent supply unit valve 200. The print agent supply unit valve 200 comprises a closure member 202 to selectively close a print agent inlet passage 204. The closure member 202 comprises a narrowing nose portion 206.

The print agent supply unit valve 200 and, in particular, the closure member 206, may provide improved print agent flow past the closure member 206. This may provide the further effect of improving flow and pressure distribution within a print agent supply unit and thereby improve print quality and improve print defects.

In some examples, the closure member 202 may be biased to close the print agent inlet passage.

In this example, the closure member nose portion 206 comprises a domed shape. In some examples, the nose portion 206 may be hemi-spherical. In some examples, the nose portion 206 may be parabolically shaped. In some examples, the nose portion 206 may comprise a pointed, segmental, catenary, or faceted dome shape.

Figure 5:
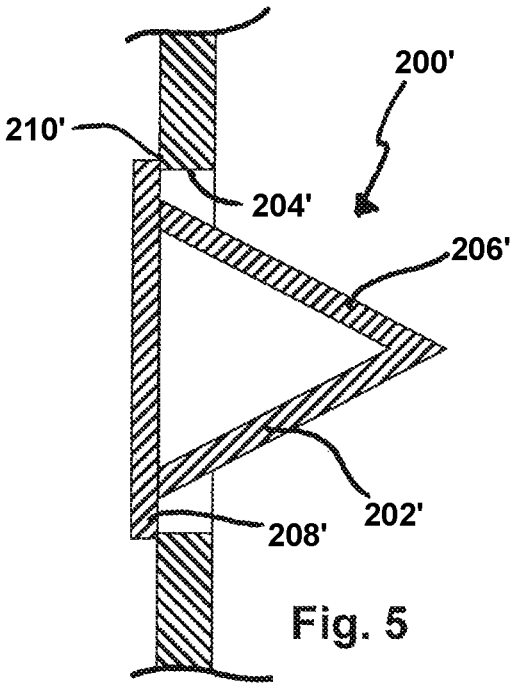
FIG. 5 is a schematic representation of an example print agent supply unit valve.

FIG. 5 shows an examples of a print agent supply unit valve 200'. The print agent supply unit valve 200' comprises a closure member 202' to selectively close a print agent inlet passage 204'. The closure member 202' comprises a narrowing nose portion 206'.

In this example, the closure member nose portion 206' comprises a conical shape. In some examples, the closure member nose portion 206' may comprise a pyramidal shape.

In this example, the closure member comprises a radial projection 208' to seal against the print agent inlet passage 204'. In this example, the radial projection 208' is formed about an entire circumference of the valve member 202'. In this example, the radial projection 202' may seal against an annular area 210' about the print agent inlet passage 204'.

Figure 6:
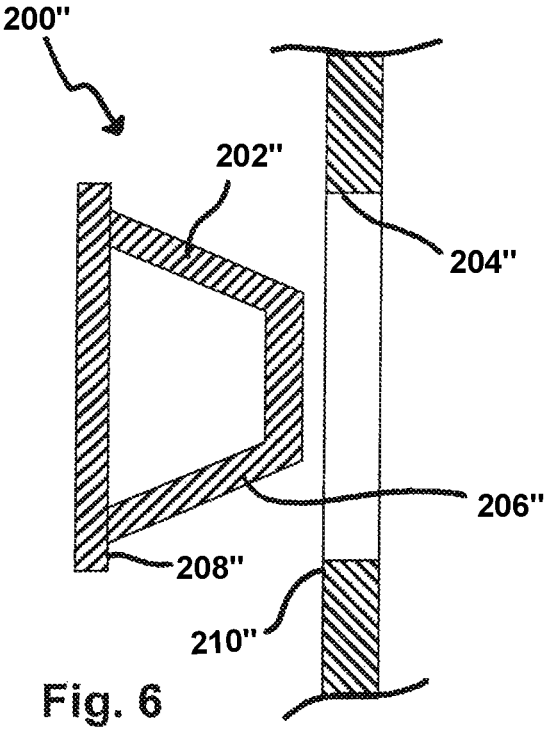
FIG. 6 is a schematic representation of an example print agent supply unit valve.

FIG. 6 shows an example of a print agent supply unit valve 200". The print agent supply unit valve 202" comprises a closure member 202" to selectively close a print agent inlet passage 204". The closure member 202" comprises a narrowing nose portion 206".

In this example, the closure member nose portion 206" comprises a frustoconical shape. In some examples, the closure member nose portion 206" may comprise a frustopyramidal shape.

In this example, the closure member comprises a radial projection 208" to seal against an annular area 210" about the print agent inlet passage 204".

In some examples of print agent supply unit valves, the closure member may additionally comprise a narrowing tail portion. In such examples, the closure member may have a maximum width or diameter at a middle portion thereof between an upstream end and downstream end of the closure member. Such a closure member may comprise some or all features of the example stopper of FIG. 10 below.

Figure 7:
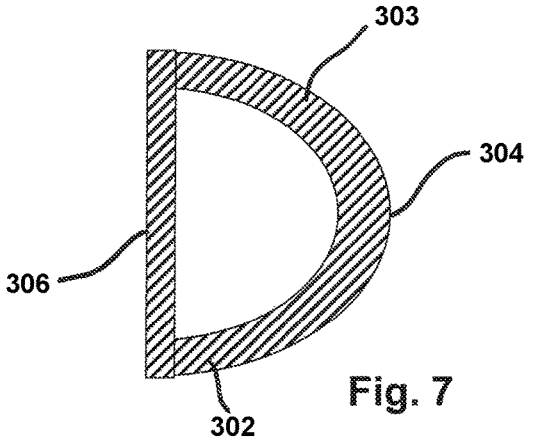
FIG. 7 is a schematic representation of an example stopper for a print agent supply unit.

FIG. 7 is an example of a stopper 302 for a print agent supply unit. The stopper 302 has a gradually widening profile 303 from a front portion 304 of the stopper 302 to a widened portion 306 of the stopper 302. In this example, the widened portion 306 is rearward of the front portion 304. In some examples, the widened portion 306 may be a rearmost portion of the stopper 302. In some examples, the widedned portion 306 may be a widest portion of the stopper 302.

The stopper 302 may provide improved print agent flow and pressure distribution into a print agent supply unit and an inlet chamber thereof, thereby have the effect of improving print quality and improving print defects.

In this example, the stopper profile 303 widens arcuately from the front portion 304 to the widened portion 306. In other words, the stopper profile 303 may comprise a dome shape, or a curved shape.

Figure 8:
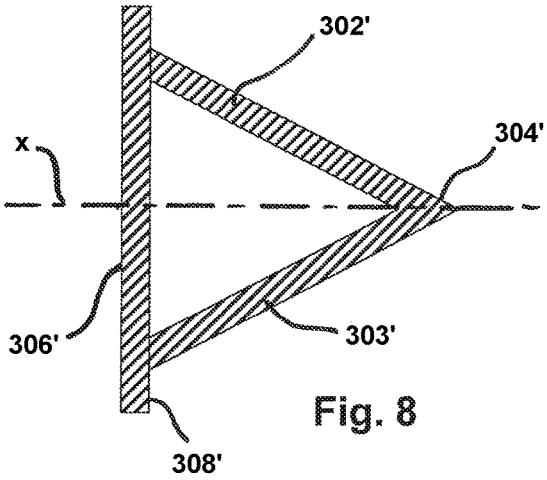
FIG. 8 is a schematic representation of an example stopper for a print agent supply unit.

FIG. 8 is an example of a stopper 302' for a print agent supply unit. The stopper 302' has a gradually widening profile 303' from a front portion 304' of the stopper 302' to a widened portion 306' of the stopper 302'.

In this example, wherein the stopper profile 303' widens linearly from the front portion 304' to the widened portion 306'. In this example, the stopper profile 303' comprises a conical shape. In some examples, the stopper profile 303' may comprise a pyramidal shape.

In this example, the stopper has a main longitudinal axis x. In some examples, the stopper 302' may be axisymmetric about the longitudinal axis x. In use, the stopper 302' may be arranged such that the longitudinal axis x is generally parallel to a direction of flow of print agent directed towards the stopper 302', with the front portion 304' of the stopper 302' directed into the flow of print agent.

In this example, the stopper 302' comprises an annular protrusion 308' at the widened portion 306'. In this example, the annular projection 308' is formed about an entire circumference of the valve member 302'. The annular protrusion 308' may be to seal against a print agent inlet passage.

Figure 9:
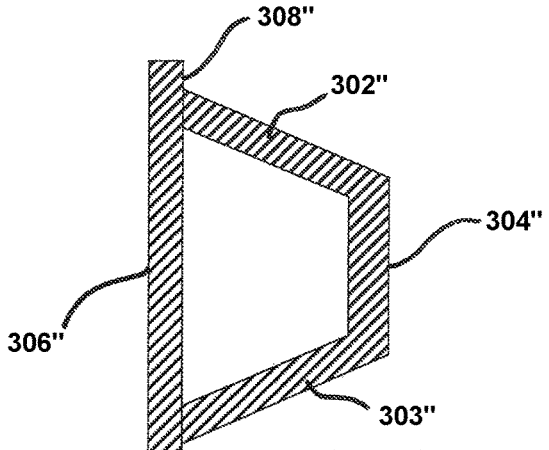
FIG. 9 is a schematic representation of an example stopper for a print agent supply unit.

FIG. 9 is an example of a stopper 302" for a print agent supply unit. The stopper 302" has a gradually widening profile 303" from a front portion 304" of the stopper 302" to a widened portion 306" of the stopper 302".

In this example, wherein the stopper profile 303" widens linearly from the front portion 304" to the widened portion 306". In this example, the stopper profile 303" comprises a frustoconical shape. In some examples, the stopper profile 303" may comprise a frustopyramidal shape.

In this example, the stopper 302" comprises an annular protrusion 308" at the widened portion 306". In this example, the annular protrusion 308" is formed about an entire circumference of the valve member 302'. The annular protrusion 308" may be to seal against a print agent inlet passage.

Figure 10:
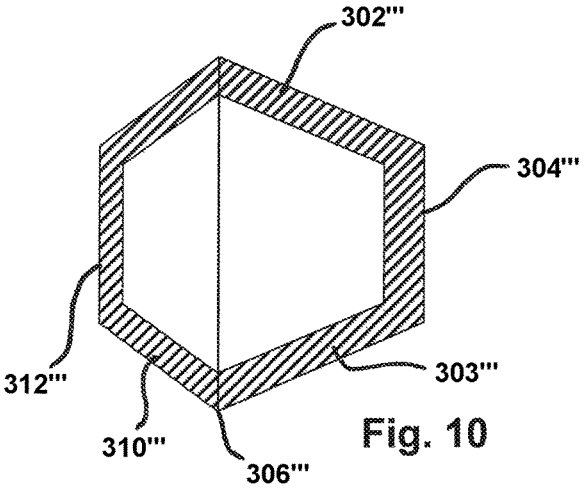
FIG. 10 is a schematic representation of an example stopper for a print agent supply unit.

FIG. 10 is an example of a stopper 302" for a print agent supply unit. The stopper 302" has a gradually widening profile 303" from a front portion 304" of the stopper 302" to a widened portion 306" of the stopper 302".

In this example, the stopper 302" has a gradually narrowing profile 310" from the widened portion 306" to a rear portion 312" of the stopper 302". In this example, the rear portion 312" may be a rearmost portion of the stopper 302". The narrowing profile 310" may narrow linearly, curvedly, or arcuately similarly to the widening profile 303". The widened portion 306" may be a widest portion of the stoper 302". The widened portion 306" may be arranged between the front portion 304" and the rear portion 312". In some examples, the widened portion 306" may be downstream of the front portion 304" and upstream of the rear portion 312".

In some examples, the narrowing profile 310" may be referred to as a tapering profile. In some examples, the narrowing profile 310" may be referred to as a narrowing downstream profile and the widening profile 303" may be refered to as a widening upstream profile.

The narrowing profile 310" rearward of the widened portion 306" may further improve or ease flow of print agent past the stopper 302", thereby improving flow and pressure distribution along an inlet chamber and roller of a print agent supply unit in which the stopper is installed. In some examples, the stopper may also be referred to as a valve member or closure member.

In some examples, the valve members, closure members, and stoppers described herein with relation to the examples of FIGS. 1-9 may comprise a narrowing profile like that of the example of FIG. 10.

While the apparatus and related aspects have been described with reference to certain examples, various modifications, changes, omissions, and substitutions can be made without departing from the spirit of the present disclosure. It is intended, therefore, that the method, apparatus, and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print agent supply unit comprising:

an inlet chamber to distribute print agent within the print agent supply unit;

a valve to selectively permit print agent into the inlet chamber, the valve comprising:

a print agent inlet opening; and a valve member to selectively close the print agent inlet opening, the valve member being tapered towards an upstream end of the valve member;

an annular ring disposed upstream of the valve member in the inlet opening; and a bar connecting the annular ring and the valve member.

2. A print agent supply unit as claimed in claim 1, wherein the valve member is biased to close the print agent inlet opening.

3. A print agent supply unit as claimed in claim 2, further comprising an opening mechanism to overcome the biasing of the valve member and thereby open the print agent inlet opening when the print agent supply unit is installed in a print apparatus.

4. A print agent supply unit as claimed in claim 1, wherein the valve member is tapered linearly or curvedly towards the upstream end.

5. A print agent supply unit as claimed in claim 1, wherein the valve member is tapered towards a downstream end.

6. A print agent supply unit as claimed in claim 1, wherein the valve member comprises a radially-extending flange at a downstream end of the valve member to abut an annular area about the print agent inlet opening.

7. A print agent supply unit comprising a print agent supply unit valve, the print agent supply unit comprising:

an inlet chamber to receive a liquid print agent;

a print application roller to produce a film of print agent from print agent held in the inlet chamber; and the print agent supply valve located at an inlet passage of the inlet chamber to selectively allow print agent to flow into the inlet chamber from a supply, the valve comprising a closure member to selectively close the print agent inlet passage of the print agent supply unit, the closure member comprising a narrowing nose portion.

8. A print agent supply unit as claimed in claim 7, wherein the closure member is biased to close the print agent inlet passage.

9. A print agent supply unit as claimed in claim 7, wherein the closure member nose portion comprises a conical shape, a frustoconical shape, or a domed shape.

10. A print agent supply unit as claimed in claim 7, wherein the closure member comprises a narrowing tail portion.

11. A print agent supply unit as claimed in claim 7, wherein the closure member comprises a radial projection to seal the print agent inlet passage.

12. A print agent supply unit as claimed in claim 7, wherein the closure member nose portion is hemispherically or parabolically shaped.

13. A print agent supply unit as claimed in claim 7, further comprising a spring located inside the inlet chamber to bias the closure member to close the print agent inlet passage.

14. A print agent supply unit as claimed in claim 7, further comprising:

an annular ring disposed upstream of the closure member in the inlet passage; and a bar connecting the annular ring and the closure member.

15. A print agent supply unit as claimed in claim 7, wherein the closure member nose portion has a segmental, catenary, or faceted dome shape.

16. A stopper for a print agent supply unit, the stopper having:

a front portion pointed into an upstream direction from which a liquid print agent flows to and around the stopper;

a gradually widening stopper profile from the front portion of the stopper to a widened portion of the stopper rearward of the front portion in the flow direction of the print agent; and a flat rear portion inside and facing a chamber of the print agent supply unit that receives the liquid print agent after the liquid print agent flows past the stopper.

17. A stopper as claimed in claim 16, wherein the stopper profile widens linearly or arcuately from the front portion to the widened portion.

18. A stopper as claimed in claim 16, wherein the stopper comprises an annular protrusion at the widened portion.

19. A stopper as claimed in claim 16, wherein the stopper profile comprises a gradually narrowing profile from the widened portion to a rear portion of the stopper.

* * * * *